US006679165B2

(12) United States Patent
Shih

(10) Patent No.: US 6,679,165 B2
(45) Date of Patent: Jan. 20, 2004

(54) WINDOW ADAPTED TO A DATER

(76) Inventor: Shiny Shih, No. 31, Lane 349, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 10/152,938

(22) Filed: May 22, 2002

(65) Prior Publication Data

US 2003/0217653 A1 Nov. 27, 2003

(51) Int. Cl.[7] ..... B41J 1/60; B41J 27/00; E05C 1/12

(52) U.S. Cl. ..... 101/110; 101/98; 101/101; 101/103; 101/108; 292/169

(58) Field of Search ..... 101/108, 103, 101/101, 98, 110; 292/169

(56) References Cited

U.S. PATENT DOCUMENTS 5,819,650 A * 10/1998 Shih ..... 101/111
6,113,160 A * 9/2000 Johansson et al. ..... 292/169

* cited by examiner

*Primary Examiner*—Andrew H. Hirshfeld
*Assistant Examiner*—Marvin P. Crenshaw
(74) *Attorney, Agent, or Firm*—Jackson Walker L.L.P.

(57) ABSTRACT

A window adapted to a dater has a screen hole adapted to be defined to correspond to lead numerals of the dater, two positioning seats oppositely formed to be detachable to the dater, and a patterned face formed on a bottom face thereof. The window is able to be detachably connected to the dater so as to allow replacement of the window for another patterned face for the dater.

2 Claims, 7 Drawing Sheets

WINDOW ADAPTED TO A DATER

BACKGROUND OF THE INVENTION

1. Field of the Invention

The present invention relates to a window, and more particularly to a window adapted to a dater. The window has a through hole defined to correspond to a stamping space in a saddle and stamping numerals of the dater so that the stamping area of the dater is limited by the window.

2. Description of Related Art

A dater normally is used to stamp the date or a series of numerals on a paper so as to be a proof of when the paper is received or reviewed. A conventional dater is shown in FIG. 6, which has a body (80), a plurality of adjusting wheels (81) rotatably received in the body (80), multiple belts (82) each corresponding to one of the adjusting wheels (81) and having numerals such as 0, 1, 2, 3 etc. formed thereon and a cap (83) movably mounted on a distal end of the body (80). When the numerals are needed to be changed, the user first moves the cap (83) from engagement with the adjusting wheels (81) such that the adjusting wheels (81) are able to drive the belts (82) to rotate. Due to the rotation of the belts (82), the numerals on the belts (82) are also changed. After the chosen numerals are set, the user pushes the cap (83) back to engage the cap (83) to the adjusting wheels (81) so as to lock the adjusting wheels(81). This kind of dater can serve only one function, that is to print numerals on a surface and nothing else.

With reference to FIG. 7, another conventional dater has a body (90) with a space (91) defined therein, a pivotal seat (92) received in the body (90) and being able to pivot 180° relative to the body (90) and an ink pad (93) provided on top of the pivotal seat (92). Inside the pivotal seat (92), multiple adjusting wheels (94) are provided in the space (91). Between each two adjacent adjusting wheels (94) a belt with lead numerals (941) formed on the belt is provided and thus controlled by a corresponding one of the adjusting wheels (94). It is noted that when the dater of this kind is not in use, all the numerals (941) on the belt are engaged with the ink pad (93) so that the numerals (941) to stamp an item via the space (91) are all fully coated with ink. Therefore, when a user is using the dater and holds the handle (96) which is on top of the dater to push downward, the numerals (941) originally engaged with the ink pad (93) are pivoted along with the pivotal seat (92). When the pivotal seat (92) pivots, the pivotal seat (92) also descends so as to allow the ink-coated numerals (941) to stamp a surface.

This kind of dater only provides numerals or simple lettering on a surface. To those who need to show a company name etc as well as the numerals, it is not possible for the dater to meet the need. In order to overcome the shortcoming, another dater is provided to the market. The dater has a name pad securely attached to the bottom face of the body (90) and has a through hole communicating with the space (91) and corresponding to the numerals (941). The name pad is provided with a specific pattern, such as characters, pictures or the like. When the dater of this kind is applied onto a surface, the numerals as well as the pattern are printed on the surface. However, this name pad is securely attached to the bottom of the body and it is impossible to change the pattern on the name pad. Therefore, when changing the pattern is required, removal of the name pad and replacing it with a new one seems the most logical manner to fulfil the requirement. However, when switching between patterns is required, it seems that the user will have to buy two different daters to accomplish the purpose, which is quite a waste and labor inefficient.

To overcome the shortcomings, the present invention tends to provide an improved window for a dater to mitigate and obviate the aforementioned problems.

SUMMARY OF THE INVENTION

The primary objective of the present invention is to provide a window detachably connected to a dater so that the user is able to replace the window when required.

Other objects, advantages and novel features of the invention will become more apparent from the following detailed description when taken in conjunction with the accompanying drawings.

DETAILED DESCRIPTION OF THE PREFERRED EMBODIMENT

Figure 1:
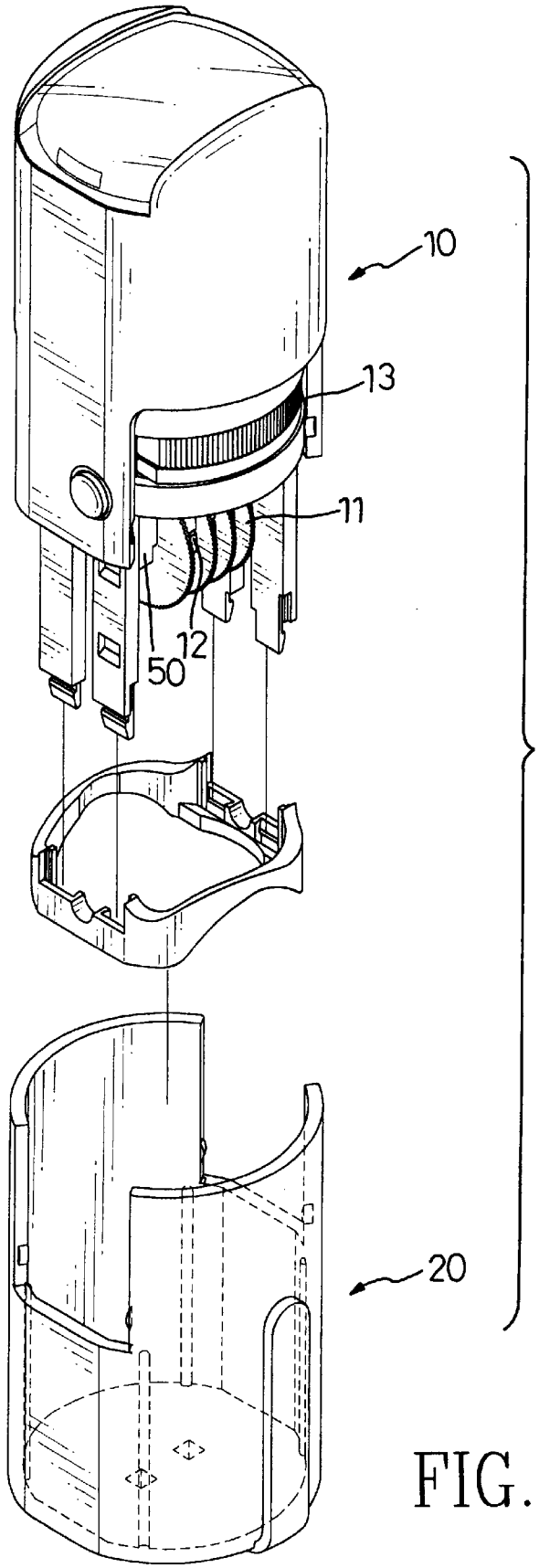
FIG. 1 is an exploded perspective view of a dater.

With reference to FIG. 1, a dater has a body (10) and a casing (20) detachably connected to the body (10) for protecting adjusting wheels (11) inside the body (10).

The body (10) further has lead numerals (12) and an ink pad (13) on top of the lead numerals (12). The lead numerals (12) are rotatably received between adjacent adjusting wheels (11). The adjusting wheels (11) as well as the numerals (12) are securely mounted on a pivotal seat (50) which is able to pivot relative to the body (10) when the body (10) is experiencing a downward force on a top face of the body (10). The ink pad (13) is provided on top of the adjusting wheels (11) and engaged with the lead numerals (12) so that the lead numerals (12) are able to be coated with ink when a surface is to be stamped. The operation of the dater and how the pivotal seat (50) pivots relative to the body (10) are conventional in the art and are not the essence of the present invention, therefore, they are omitted hereinafter.

Figure 2:
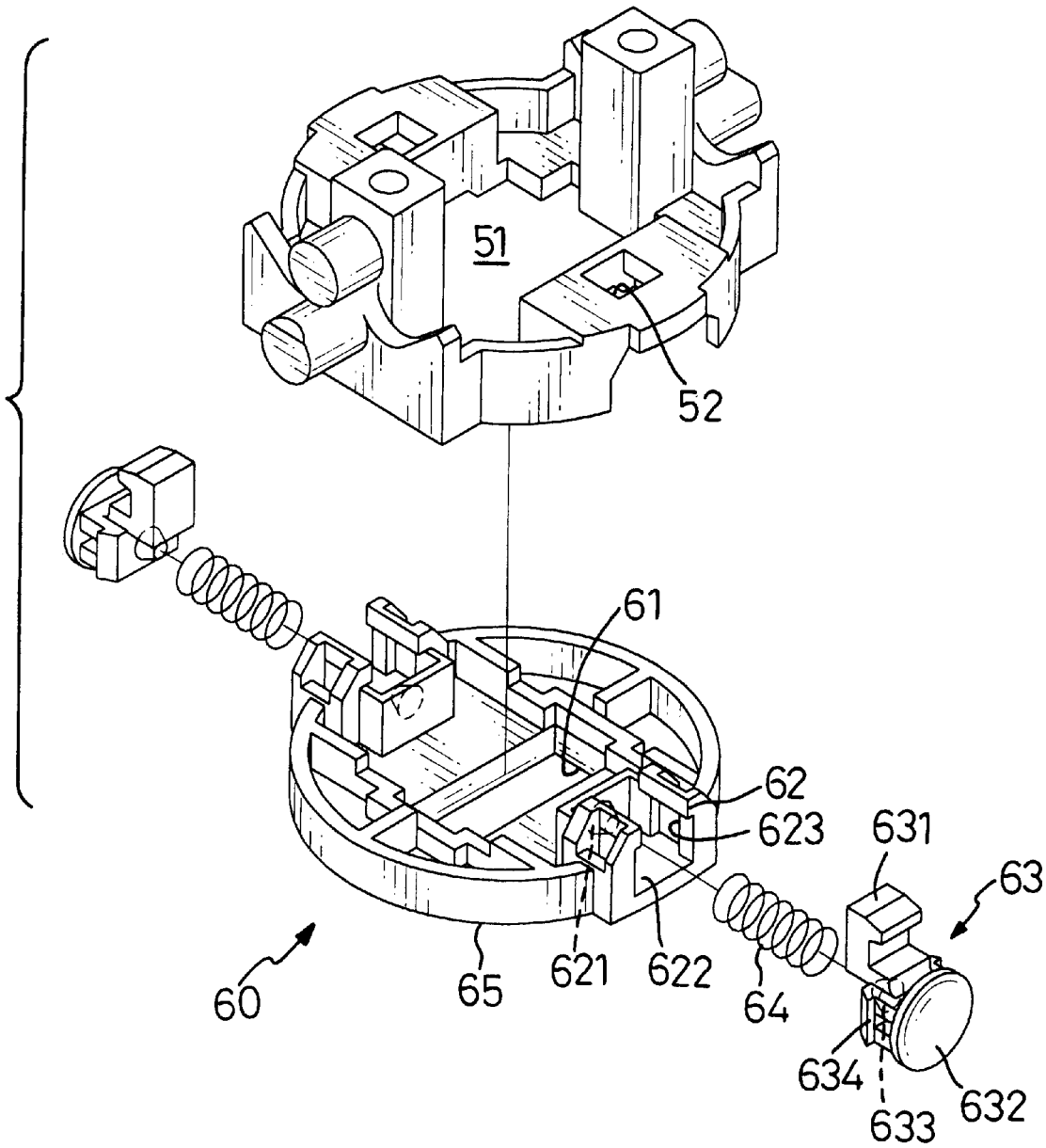
FIG. 2 is a perspective view of the window together with a pivotal member received in the dater in FIG. 1.

With reference to FIG. 2, the pivotal seat (50) has a through hole (51) defined to correspond to the lead numerals (12) and two cutouts (52) oppositely defined in the pivotal seat (50). The window (60) has a screen hole (61) defined to correspond to the through hole (51) of the pivotal seat (50). Two positioning seats (62) are oppositely formed on the window (60) and each has an extension (621) extending out therefrom, a centrally defined space (622) and an indentation (623) defined in opposite side faces defining the space (622). A buckle (63) is provided for each of the positioning seats (62). The buckle (63) has a hook (631) formed to correspond to the cutout (52) of the pivotal seat (50), an engaging face (632) and a positioning rod (633) formed to correspond to the extension (621). Two claws (634) extend out from both sides of the hook (631) to correspond to the indentations (623) in the positioning seat (62). A spring (64) is located between the positioning rod (633) and the extension (621). The most important feature of the window (60) is that there is a patterned face (65) formed on a bottom face of the window (60).

When the window (60) is to be assembled with the pivotal seat (50), the two claws (634) extend into the two indentations (623) so as to securely connect the buckle (63) to the positioning seat (62). When the buckle (63) is securely connected to the positioning seat (62), the spring (64) is compressibly received between the positioning seat (62) and the buckle (63) and guided by the positioning rod (633) and the extension (621). After both buckles (63) are assembled with the positioning seats (62), the window (60) is moved upward to extend the hooks (631) into the corresponding cutouts (52) in the pivotal seat (50), such that the buckles (63) are able to be securely engaged with the pivotal seat (50).

Figure 3:
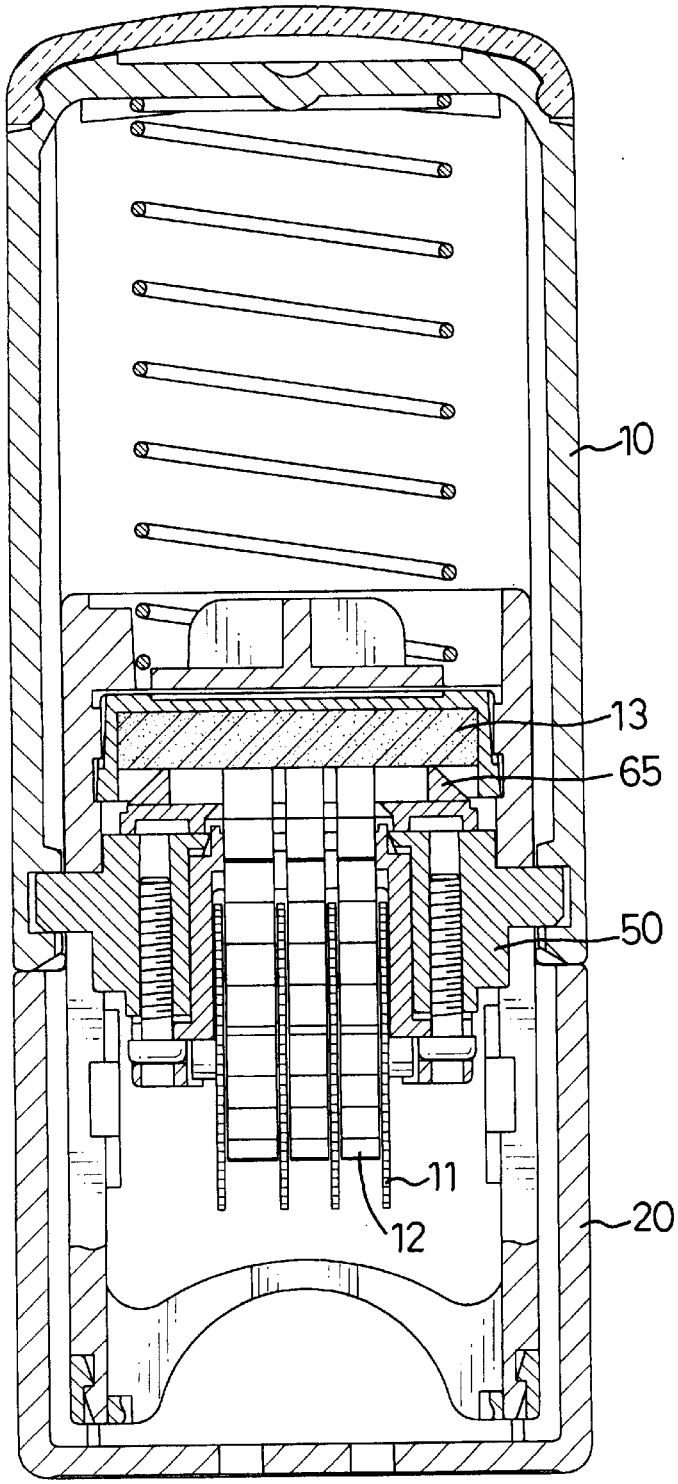
FIG. 3 is a cross sectional view showing the assembly of the window in the dater.

With reference to FIG. 3, after the assembly between the pivotal seat (50) and the window (60), it is noted that the patterned face (65) as well as the lead numerals (12) are engaged with the ink pad (13) so as to allow the ink in the ink pad (13) to coat not only the lead numerals (12) but also the patterned face (65).

Figure 4:
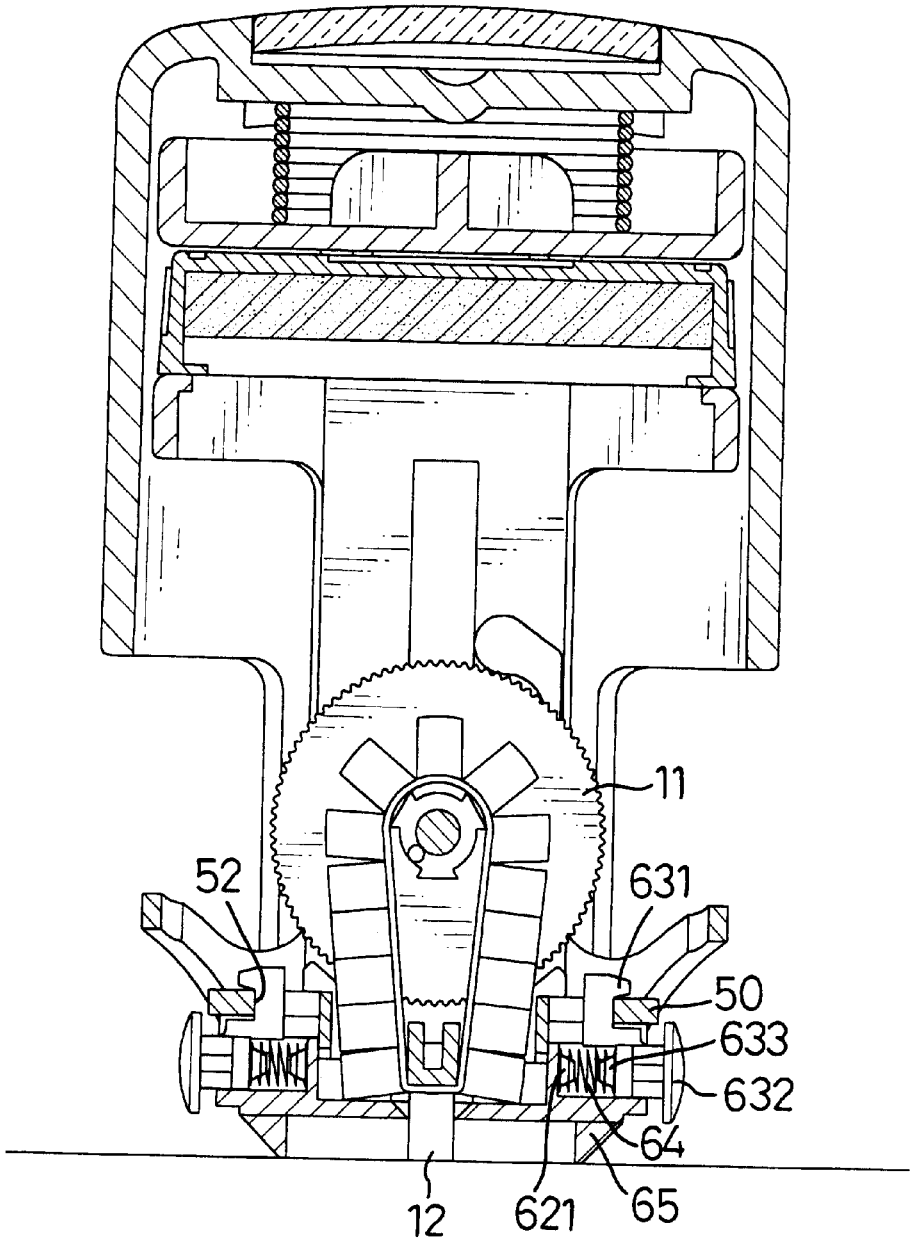
FIG. 4 is a cross sectional view showing the application of the dater of the present invention.

With reference to FIG. 4, when the user is using the dater, the casing (20) is first removed from the body (10). A force applied to the body (10) is able to force the pivotal seat (50) to pivot. Thus, the lead numerals (12) as well as the patterned face (65) is turned to engage with a surface so that the ink on the lead numerals (12) and the patterned face (65) is printed on the surface.

Figure 5:
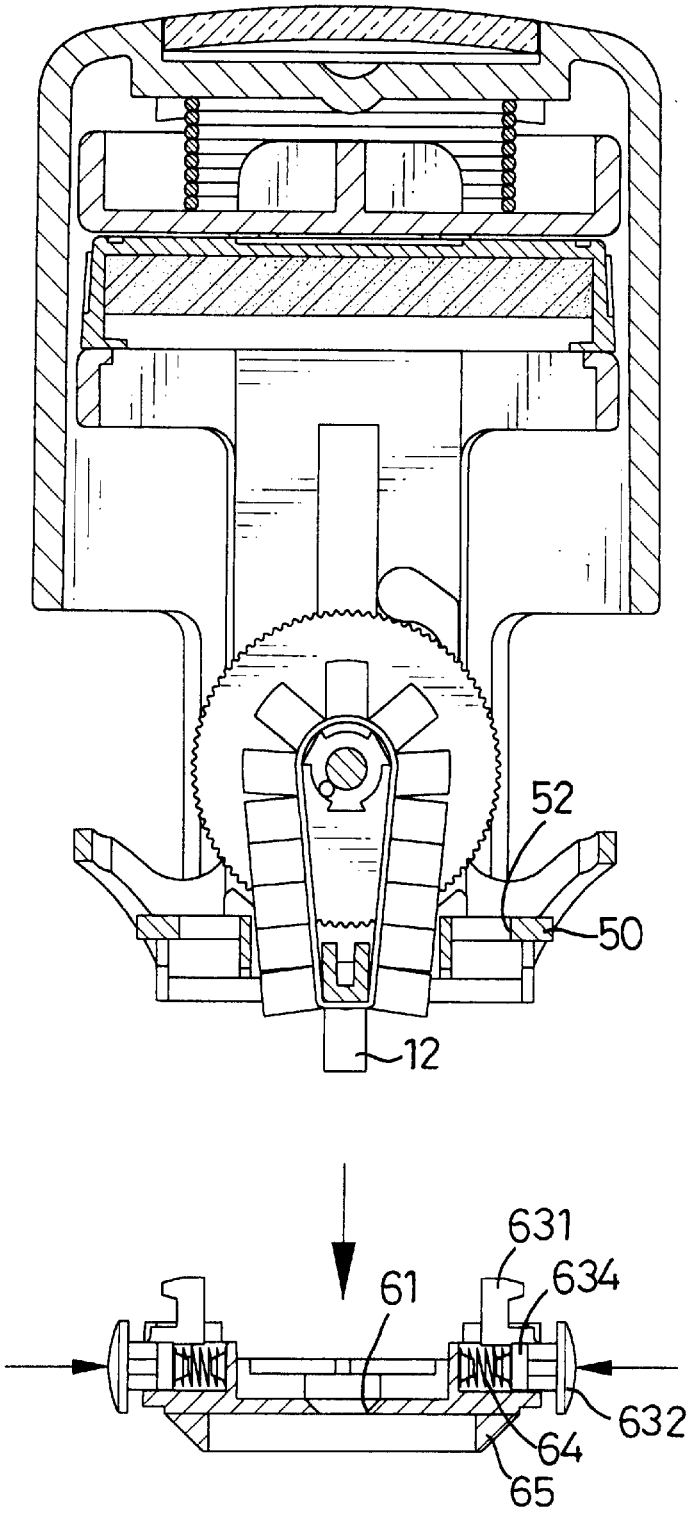
FIG. 5 is a schematic view showing the adjustment of the numerals after the window is moved away from the dater.
Figure 6:
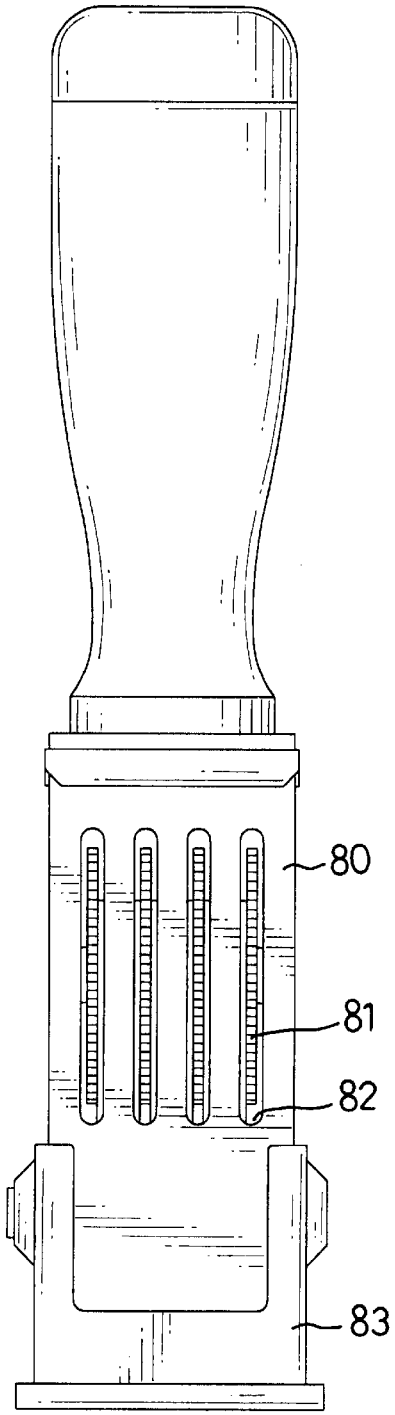
FIG.6 PRIOR ART
FIG. 6 is a plan view showing a conventional dater.
Figure 7:
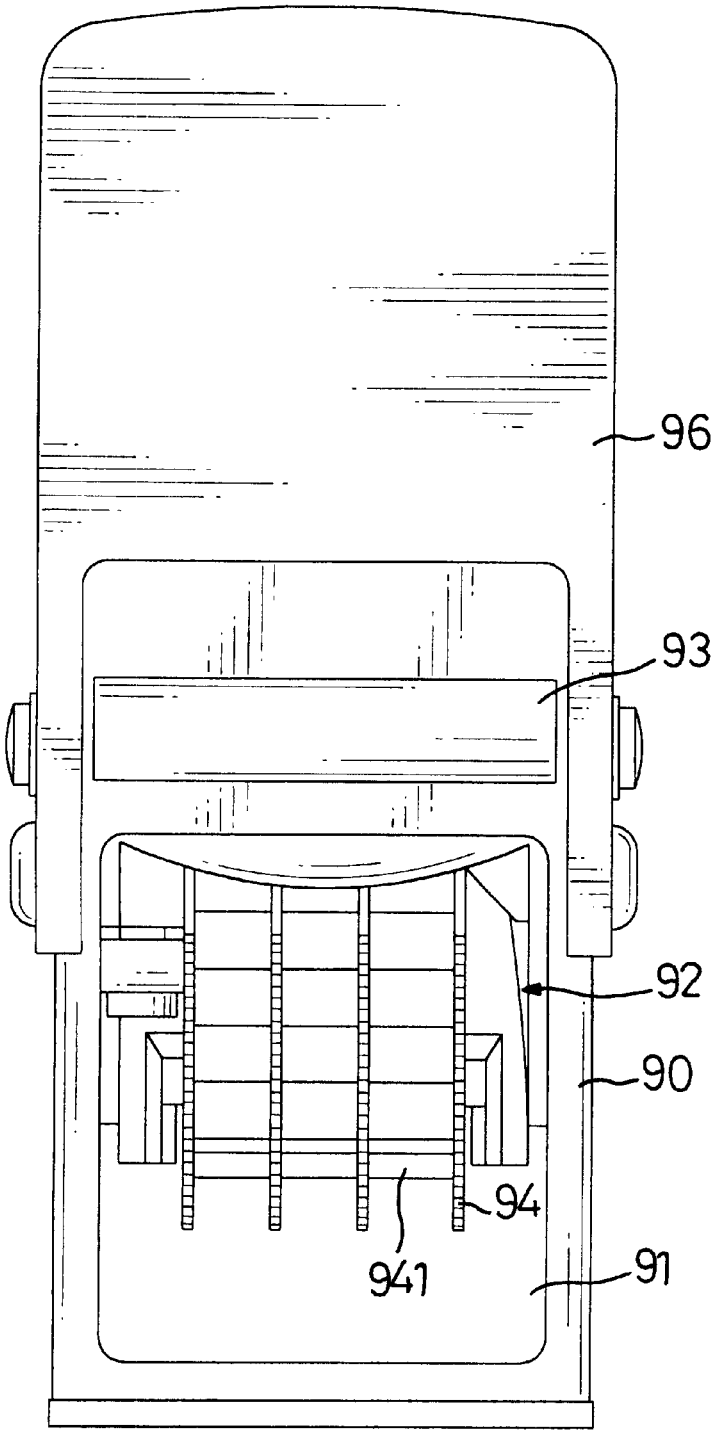
FIG.7 PRIOR ART
FIG. 7 is a plan view showing a conventional dater.

With reference to FIG. 5, when the user wants to use another pattern to go with the lead numerals (12), the user presses the buckles (63) to release the engagement of the hooks (631) to the side faces of the cutouts (52) such that the user is able to hold the engaging faces (632) of the two opposite buckles (63) to separate the window (60) from the pivotal seat (50).

From the foregoing description, it is to be noted that the window (60) constructed in accordance with the present invention is able to provide convenience to the user when a different pattern is frequently needed to go with the lead numerals (12). That is, the detachable engagement mechanism of the window (60) to the dater allows the user to readily change the pattern required so as to meet the requirement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A window adapted to a dater, the window comprising:

a screen hole adapted to be defined to correspond to lead numerals of the dater;

two positioning seats oppositely formed to be detachable to the dater, wherein each positioning seat has a buckle movably received in a centrally defined space in the positioning seat for selectively engaging the dater, wherein the buckle has a hook adapted to be formed to engage with a cutout in the dater, two claws extending from both sides of the hook to engage with indentations oppositely defined in side faces of the space such that the buckle is able to securely engage with the positioning seat of the window; and a patterned face formed on a bottom face thereof.

2. The window as claimed in claim 1 further comprising two springs respectively received between the positioning seat and the buckle so as to provide a recoil force to the buckle to allow the buckle to be movable relative to the positioning seat, whereby with the spring to provide the recoil force to the buckle, the window is able to be detachable to the dater.

* * * * *